US006536770B1

(12) United States Patent
Yang

(10) Patent No.: US 6,536,770 B1
(45) Date of Patent: Mar. 25, 2003

(54) INTELLIGENT BASKETBALL GAME ASSEMBLY

(75) Inventor: Seung Woo Yang, Seoul (KR)

(73) Assignee: P & P Idea Co., Ltd., Seoul (KR)

( * ) Notice: Subject to any disclaimer, the term of this patent is extended or adjusted under 35 U.S.C. 154(b) by 0 days.

(21) Appl. No.: 09/687,509

(22) Filed: Oct. 12, 2000

(30) Foreign Application Priority Data

Aug. 31, 2000 (KR) ..... 2000-50980

(51) Int. Cl.[7] ..... A63F 7/20
(52) U.S. Cl. ..... 273/317.3; 273/371
(58) Field of Search ..... 473/447, 422; 273/317.3, 359, 371, 368

(56) References Cited

U.S. PATENT DOCUMENTS

| | | | | |
|---|---|---|---|---|
| 4,013,292 A | | 3/1977 | Cohen et al. | |
| 4,700,952 A | | 10/1987 | Patsy | |
| 5,035,423 A | * | 7/1991 | Arciniega | 473/433 |
| 5,074,552 A | | 12/1991 | Gomez et al. | |
| 5,312,099 A | | 5/1994 | Oliver, Sr. | |
| 5,330,175 A | * | 7/1994 | Kim | 273/397 |
| 5,358,237 A | | 10/1994 | Yu | |

* cited by examiner

*Primary Examiner*—Paul T. Sewell
*Assistant Examiner*—M. Chambers
(74) *Attorney, Agent, or Firm*—Knobbe, Martens, Olson & Bear, LLP

(57) ABSTRACT

An intelligent basketball game assembly has a main body including a driving mechanism provided with a first moving member for moving a goal support rightward and leftward, a second moving member for moving the goal support forward and rearward, and a rotating member for rotating an upper portion of the goal support; an auxiliary body provided with operation buttons including a start button and a difficulty mode setting button, a coin insertion, a premium discharge opening through which a premium is provided, a ball stopper, a pair of ball stop supports having vertical rails along which the ball stopper is moved upward or downward. The intelligent basketball game assembly also has a control section including a button detection for detecting the player's operations of the operating buttons, a display constituted by LED or LCD to indicate score and the number of coins, a coin detection for detecting the number and the kinds of the coins given by the player, a motor driving part for controlling the operations of the first and the second moving member and the rotating member, a sensing part for detecting the position of the goal, and a sound emitter emitting music, a fanfare and a voice guide.

26 Claims, 7 Drawing Sheets

INTELLIGENT BASKETBALL GAME ASSEMBLY

BACKGROUND OF THE INVENTION

1. Field of the Invention

The present invention relates to an intelligent basketball game assembly; and, more particularly, to an intelligent basketball game assembly provided with a basketball goal capable of moving forward, rearward, leftward and rightward, and rotating 90° clockwise and counterclockwise along with a backboard.

2. Description of the Background

A basketball game assembly, in general, allows people to enjoy a basketball game in an indoor facility such as an amusement park, home, etc. rather than in a place such as an outdoor court provided with a real basketball goal, with a player getting pleasant and excited by factors from a simulated sport and factors of amusement, and obtaining an additional effect of exercise.

This basketball game assembly is normally operated in such a manner that the player repeatedly shoots the basketballs toward a goal or hoop mounted to a fixed backboard within a given period of time and a score is displayed on a basis of the number of goals, with a time extension of more several seconds being given to the player when the score is over a predetermined value.

This type of basketball game assembly with the fixed goal or backboard, however, cannot provide the player with various shooting environment at different angles. In order to solve this problem, a basketball game assembly constructed by assembling the components thereof has been proposed, in which the position or angle of the goal must be manually changed during the game is suspended. This is a cumbersome thing to the player and therefore is a factor allowing the player to be discomfort. Further, the basketball game assembly has a shortcoming in that its audio and display functions are not enough to tempt the people to participate in the game.

On the other hand, a basketball game having a coin-operated switch is disclosed in U.S. Pat. No. 4,013,292. The technology, however, has a shortcoming in that it does not have exciting or amusing factors, although automatically feeding the basketballs to the player and displaying the data on the time and score.

In U.S. Pat. No. 5,035,423, which is similar to the above patent, a basketball training facility is disclosed. This basketball training facility is designed for the player's shooting practice and has an enclosed region defined by a bottom wall, a front wall, a pair of lateral walls and a rear wall. The basketball training facility comprises a backboard and a goal mounted to a vertical member within the enclosed region; a means for rotating the backboard along with the goal about the vertical member; a ball returning device mounted within the enclosed region; and a means for moving the vertical member toward the player or away from the player, in order to help the player's practice. In this technology, the backboard and the goal are to be moved back and forth along a rail and are capable of rotating 90° clockwise and counterclockwise by means of a limit switch. Further, this technology creates audio and visual distractions or disturbance to provide the player with an environment that the player encounters during a game, by means of a video and an audio cassette players. In the technology, however, the translational and rotational movements of the backboard and the goal are so simple that it can not provide the player with amusement that the player may feel under the sports simulation game.

In U.S. Pat. No. 5,358,237 modified to control the movement of the backboard and the goal, a microprocessor controls the translational and rotational movements of the backboard and the goal in a predetermined manner, with the score being displayed on a score board in an upper portion of the backboard and with sounds simulating acclamation or jeer which may occur in the real game being emitted through a speaker.

However, the patent does not provide a movement of a two-dimensional curve profile which may be obtained in combination of a forward/rearward movement and a leftward/rightward movement, being short of factors inducing a person to have an interest, e.g., giving a premium to a player of a higher score. As a result, it has a reduced commercial applicability and does not ensure a commercial success.

Accordingly, the conventional basketball game assembly described above does not provide the player with full amusement and entails much inconvenience, since the backboard and the goal are adapted to be changed in position and direction by manually or in an exceedingly simple manner.

SUMMARY OF THE INVENTION

It is, therefore, an object of the invention to provide an intelligent basketball game assembly provided with means for horizontally moving a backboard and a goal, a ball returning member for retrieving the ball, a digital sound effector, and means for providing a premium, wherein the backboard and the goal are automatically moved forward, rearward, leftward and rightward to provide a nearly real basketball game with truthfulness, allowing a good player to be won a premium.

Another object of the present invention is to provide an intelligent basketball game assembly capable of achieving movements of two-dimensional curve profile by cooperating a forward/rearward movement and a leftward/rightward movement in a preprogrammed manner.

In accordance with one aspect of the present invention, an intelligent basketball game assembly has a main body including a driving mechanism provided with a first moving member for moving a goal support rightward and leftward, a second moving member for moving the goal support forward and rearward, and a rotating member for rotating an upper portion of the goal support; and an auxiliary body provided with operation buttons including a start button and a difficulty mode setting button, a coin insertion, a premium discharge opening through which a premium is provided, a ball stopper, a pair of ball stop supports having vertical rails along which the ball stopper is moved upward or downward. The intelligent basketball game assembly also has a control section including a button detection for detecting the player's operation of the operating buttons, a display constituted by LED or LCD to indicate score and the number of coins, a coin detection for detecting the number and the kinds of the coins given by the player, a motor driving part for controlling the operations of the first and the second moving member and the rotating member, a sensing part for detecting the position of the goal, and a sound emitter emitting music, a fanfare and a voice guide.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENT

A preferred embodiment of a basketball game assembly of the invention is described with reference to FIGS. 1 through 4.

Figure 1:
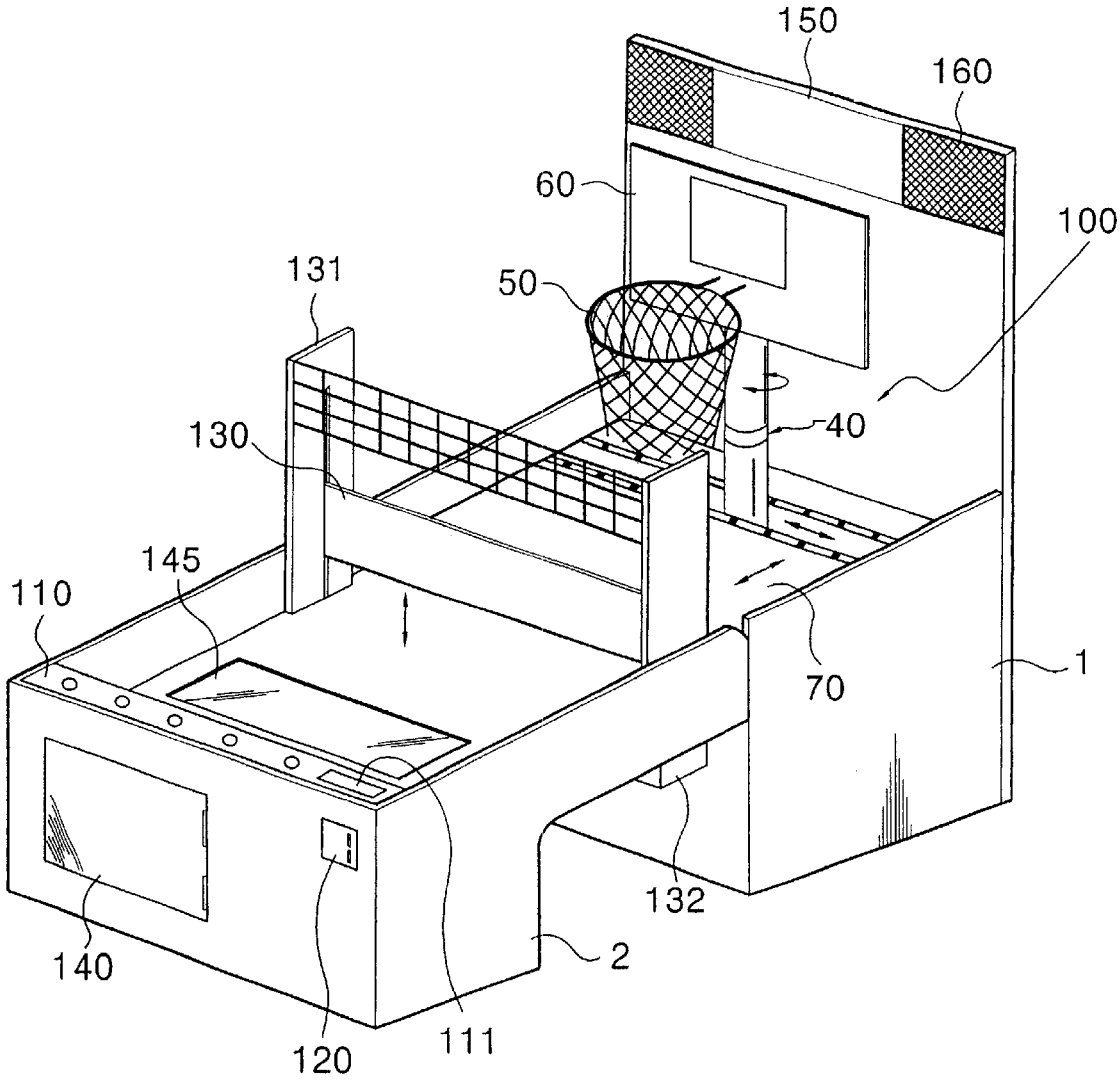
FIG. 1 illustrates a perspective view for showing the construction of an intelligent basketball game assembly of the invention.

As shown in FIG. 1, a basketball game assembly of the invention comprises a main body 1 and an auxiliary body 2.

The main body 1 has a box-like shape and a display panel 150 vertically mounted in a rear side thereof. The display panel 150 indicates operative conditions such as a degree of difficulty of a game, scores, time, and the number of coins, and has a plurality of speakers 160 for emitting digital sound of, e.g., celebration messages, acclamation or jeer, during the game or on a standby state. On the other hand, a high quality liquid crystal display device may be mounted to the display panel 150 to provide a visual effect using animation, moving picture, message display, etc. A driving mechanism 100 is mounted within the main body 1. The driving mechanism 100 is provided with means for moving a goal support 40 forward and rearward(not shown), means for moving the goal support 40 leftward and rightward(not shown) and means for rotating the goal support 40(not shown), and serves to translationally move a goal 50 and a backboard 60 forward, rearward, leftward and rightward, and to rotate the goal 50 and the backboard 60.

The auxiliary body 2 comprises operation buttons 110 such as a start button and a difficulty mode setting button, a touch pad 111 allowing a high skilled person to freely input a locus, a coin insertion 120, a premium discharge opening 140 through which the premium is offered, a ball stopper 130 operated in such a way that it comes into a contact with a ball returning member 70 to prevent basketballs from rolling down in a non-operational state while staying in an upwardly moved position to permit the basketballs therebelow to roll down during the game, a pair of ball stop supports 131 having vertical rails along which the ball stopper 130 is moved upward or downward, and a driving motor 132 connected to the ball stopper 130 by using a conventional method to allow the ball stopper 130 to be movable.

Figure 2:
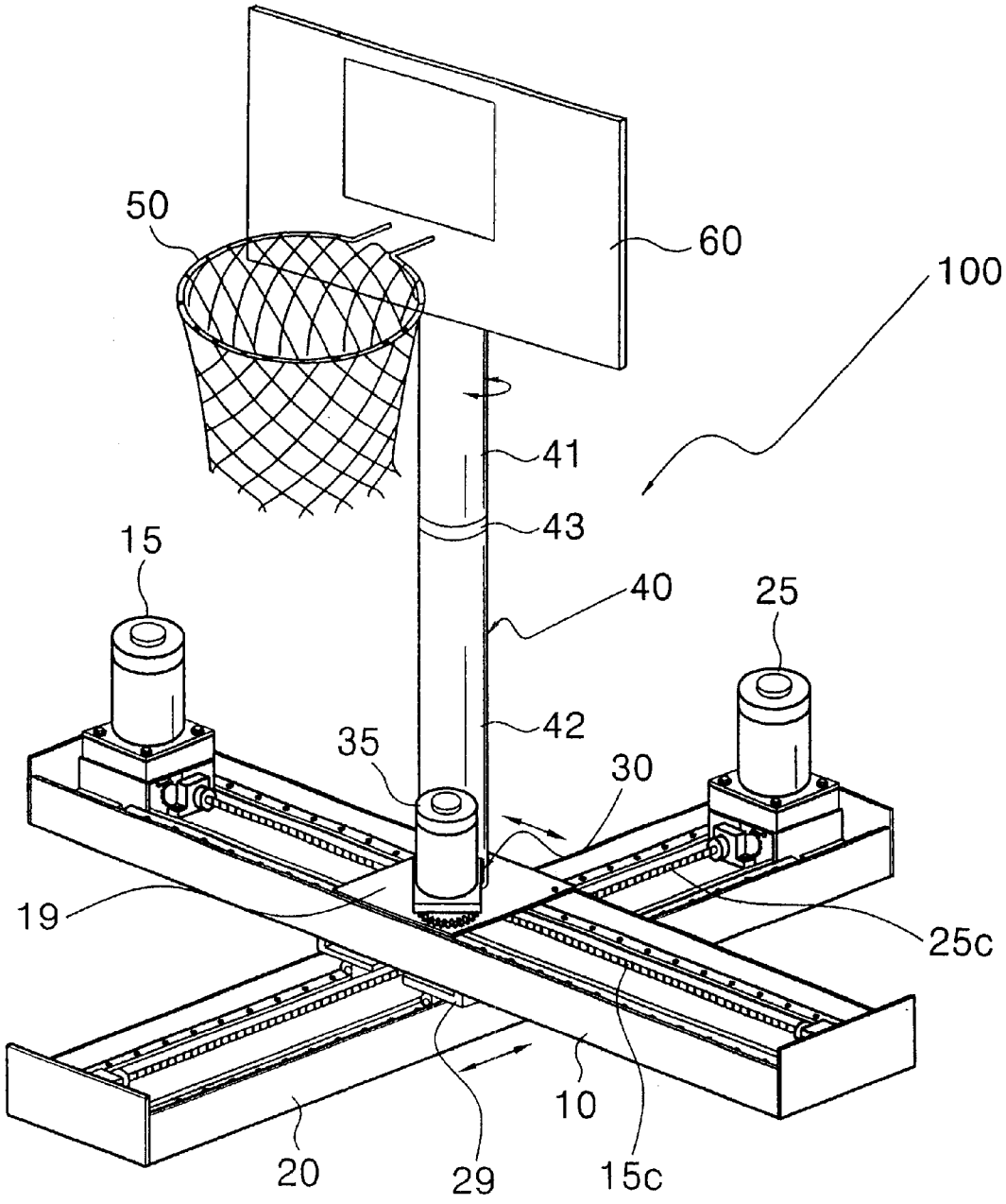
FIG. 2 shows a perspective view of horizontal movement means of the intelligent basketball game assembly shown in FIG. 1.

As shown in FIG. 2, the driving mechanism 100 includes a first moving member 10 as the means for moving the goal support 40 rightward and leftward, which is provided with a first step motor 15 electrically connected to a control section(not shown) for the supply of electricity, a second moving member 20 as the means for moving the goal support 40 forward and rearward, which is provided with a second step motor 25, and a rotating member 30 as the means for rotating an upper portion 41 of the goal support 40, which is provided with a third step motor 35.

The first moving member 10 and the second moving member 20 are arranged at a right angle with each other to make a cross-shape. A first plate 19 of the first moving member 10 vertically supports the goal support 40 while the second plate 29 of the second moving member 20 supporting the first moving member 10. The plates 19 and 29 are connected to screw shafts 15*c* and 25*c* of the first and the second moving members 10 and 20, respectively, in the same manner as a conventional ball screw. The first and the second moving members 10 and 20 constructed in this manner move the goal support 40 in a plane by reciprocating the plates 19 and 29 at the same time using a rotational force caused by the step motors 15 and 25. At the moment, electricity required to locate the goal support 40 in a certain coordination value previously stored in a motor driving part of the controller section is supplied to the first and the second step motors 15 and 25, respectively, with the first and the second step motors 15 and 25 cooperating with each other to obtain the goal support 40 in that coordination. Further, in the same manner, the movement of the rotating member 30 as well as the movements of the first and the second moving members 10 and 20 may be controlled in various manners depending upon a movement pattern programmable by the control section. For example, if the goal support 40 moves rightward by the first moving member 10, with the third step motor 35 being proportionally operated to the speed of the rightward movement, the goal support can be directed to a direction rotated by, e.g., 90 degree at the time when it arrives at a rightmost position. Since the movement pattern programmed like this can be obtained using a conventional control theory, a detailed description about that will be omitted.

Further, the backboard 60 is mounted to the upper portion 41 of the goal support 40. The upper portion 41 of a hollow pipe-like shape and a lower portion 42 having the same shape as that of the upper portion 41 are capable of rotating about each other through a thrust bearing 43.

Figure 3A:
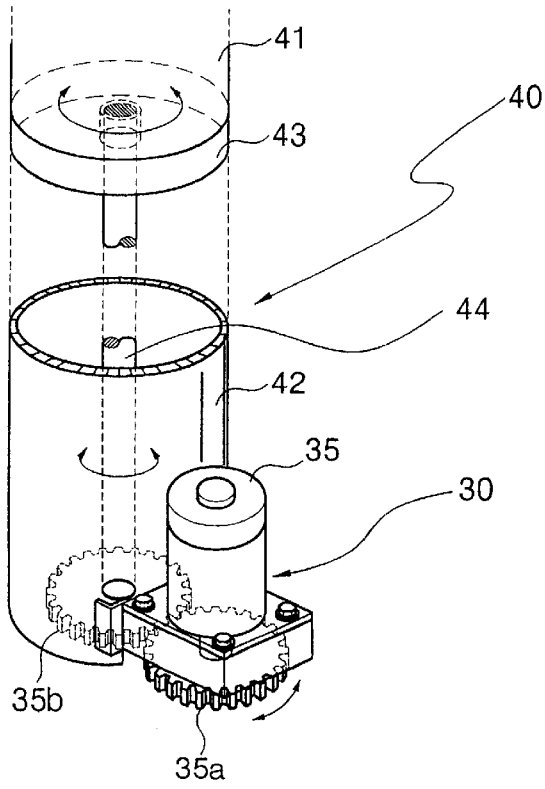
FIG. 3A depicts a partially enlarged view of the gear engagement between a third step motor and a goal support.

As shown in FIG. 3A, the upper portion 41 of the goal support 40 is fixed to an upper surface of the thrust bearing 43 at its lower end. Further, the thrust bearing 43 is fixed to an upper surface of the lower portion 42 of the goal support 40. As a result, the thrust bearing 43 serves to support weight of the upper portion 41 of the goal support 40, the goal 50 and the backboard 60, allowing the upper portion 41 of the goal support 40 to freely rotate. A thrust shaft 44 for transmitting a power from the moving member 30 is fixed to the upper portion 41 of the goal support 40 through a center of the thrust bearing 43, wherein the thrust shaft 44 has a first gear 35*b* at its lower end engaged with a second gear 35*a* of the third step motor 35. Accordingly, when the third step motor 35 rotates, the upper portion 41 of the goal support 40 can be rotated by 90 degree clockwise or counterclockwise via the thrust shaft 44.

In other words, the rotating member 30 serves to rotate the goal support 40 by 90 degree clockwise an counterclockwise by using the rotational force from the third step motor 35. At the moment, the third step motor 35 is controlled according to a control logic previously stored in the control section.

Figure 3B:
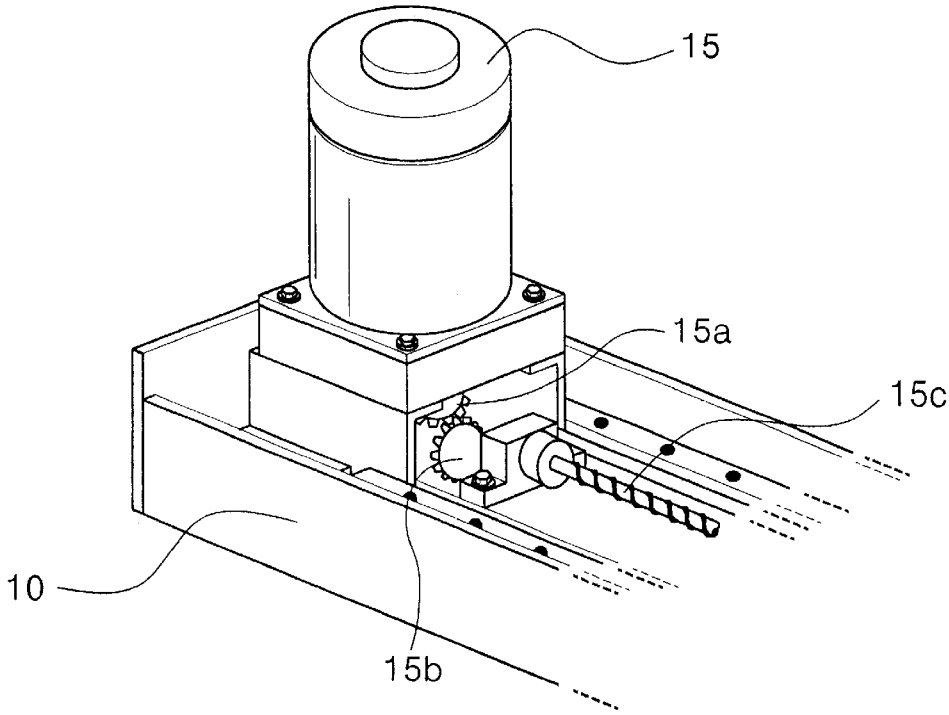
FIGS. 3B and 3C present partially enlarged views showing the connection between a first moving member and a second moving member in the horizontal movement means shown in FIG. 2.
Figure 3C:
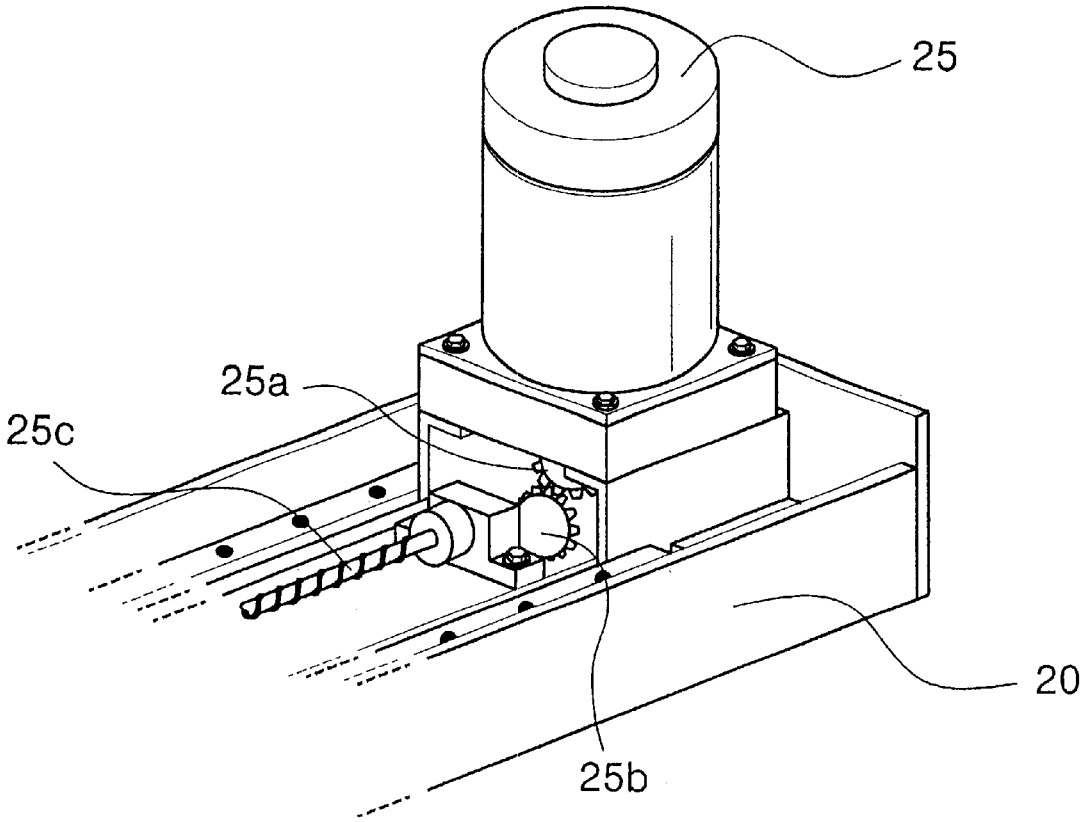

As shown in FIGS. 3B and 3C, the first moving member 10 is provided with a rail type frame in which a first shaft gear 15*b* of a screw shaft 15*c* extending in a longitudinal direction at the center of the frame is engaged with a first motor gear 15*a* of the first step motor 15. Similarly, the second moving member 20 converts the rotational force of the step motor 25 into a driving force required to the reciprocating movement by using a second shaft gear 25*b* of a screw shaft 25*c* engaged with a second motor gear 25*a* of the second step motor 25.

Figure 4:
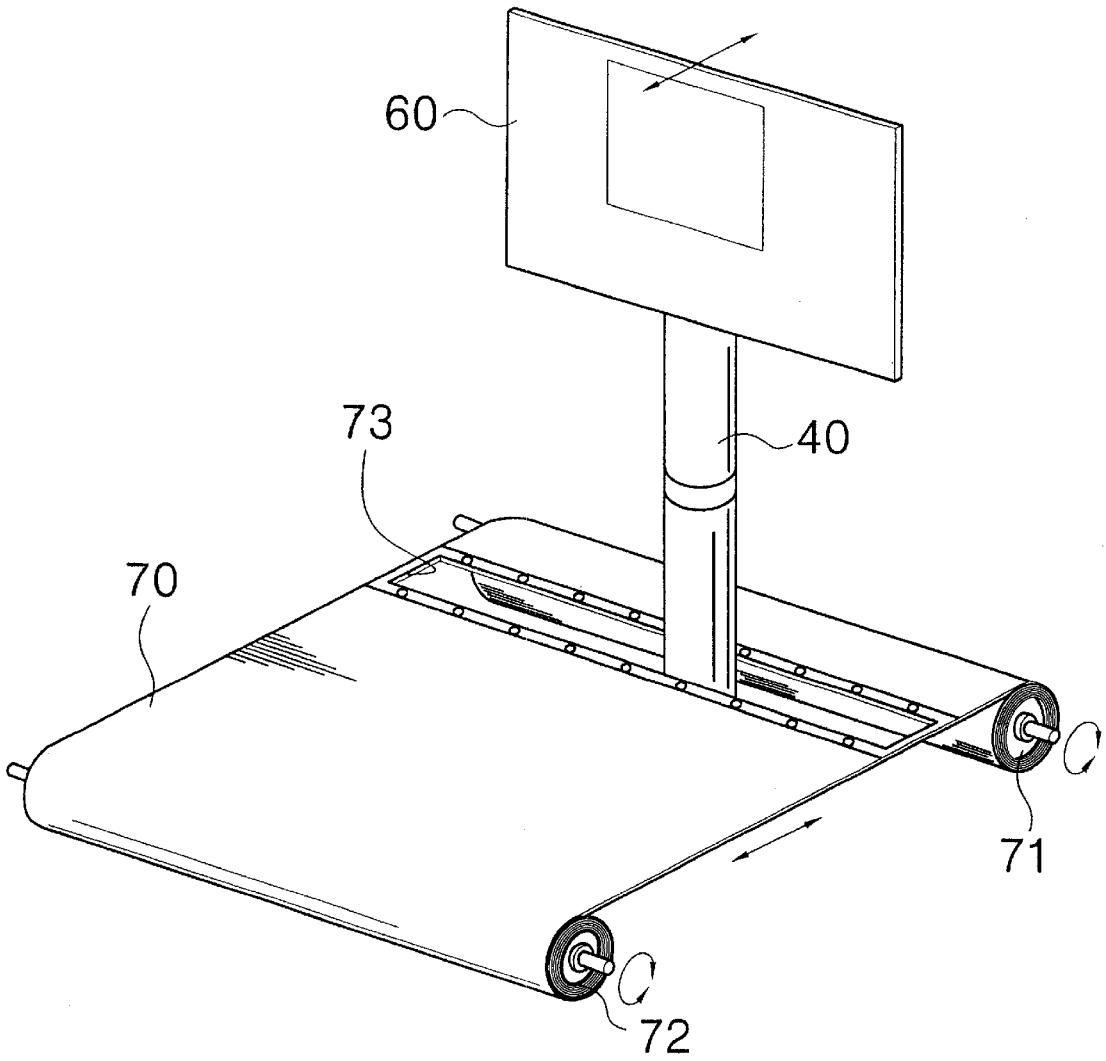
FIG. 4 represents a detailed view of a ball returning member movable in response to the movement of the goal support.

As shown in FIG. 4, a sliding slit 73 of a rectangular shape permitting the goal support 40 to move in a transversal direction is formed through the ball returning member 78. Two edges of the sliding slit 73 coming into a contact with the goal support 40 when the goal support 40 moves longitudinally are made of a material having a comparatively higher hardness. Further, the ball returning member 70 is preferably made of a rubber having a resilience in a purpose to provide a good rolling action over rollers 71 and 72.

Both ends of the ball returning member 70 are trained over the rollers 71 and 72, respectively, each of which has protrusions at both ends, being rotatably combined into the main body.

At the moment, the first roller 71 arranged in a rear portion of the main body has a level higher than that of the second roller 72, leaving the ball returning member 70 in an inclined state. That is, the inclination of the ball returning member 70 allow the basketball to be retrieved by the player. At the moment, as described above, if the first moving member 10 is operated, the goal support 40 moves along the sliding slit 73 of the ball returning member 70 in the transversal direction. Further, if the second moving member 20 is operated, the goal support 40 moves longitudinally, pushing the ball returning member 70 forward or backward, wherein the ball returning member 70 is wound around the roller 71 or 72 or wound off the roller 71 or 72, maintaining its inclined state.

Figure 5:
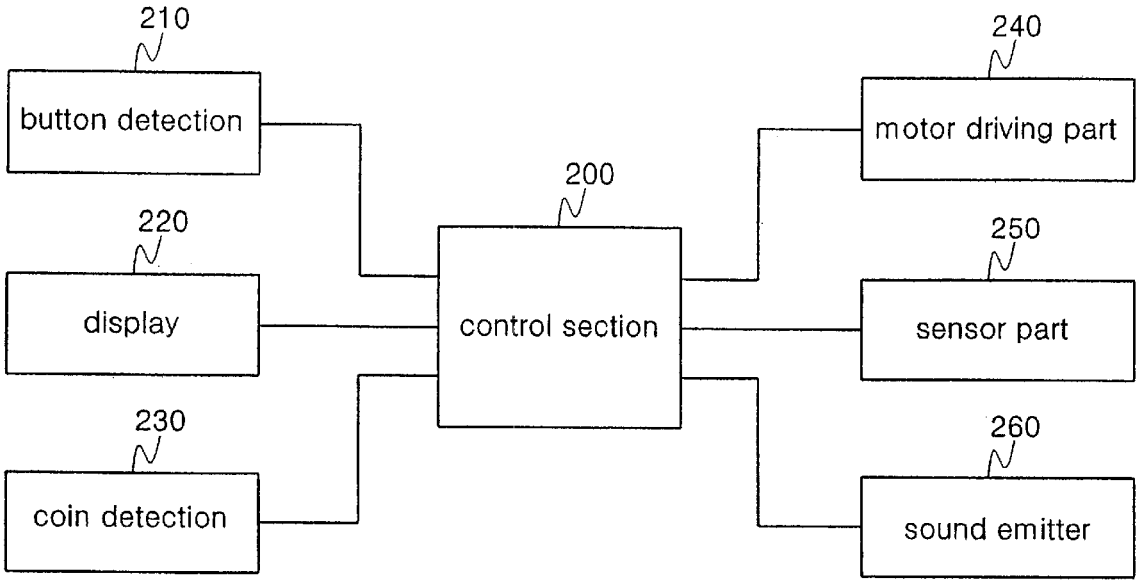
FIG. 5 describes a block diagram showing the construction of a control section of an intelligent basketball game assembly of the invention.

As shown in FIG. 5, the intelligent basketball game assembly further comprises a control section 200 for controlling an entire operation of the assembly, electrically connected to the first, the second and the third step motors. The control section 200 includes a button detection 210 for detecting the player's operations of the button and the touch pad, a display 220 constituted by LED or LCD or the like to indicate score, the number of coins, etc., and a coin detection 230 for detecting the number and the kinds of the coins given by the player. The control section 200 further includes a motor driving part 240 electrically connected to the first, the second and the third step motors to control the operations of the motors, a goal sensor for detecting a goal through the basket, and a sensing part for finding the position of the goal by using a left and right limit sensor for limiting the movement leftward and rightward, a front and rear limit sensor for limiting the movement forward and rearward and a clockwise and counterclockwise rotation limiter.

In addition, the control section 200 may further include a sound emitter 260 emitting music, a fanfare, a voice guide, etc., which is also controlled by the control section 200.

The intelligent basketball game assembly constructed in this manner includes in the auxiliary body 2 a touch pad 111 shown in FIG. 1 and controlled by the control section 200, to provide the player with his own game environment.

The touch pad 111 allows the player to freely draw a locus of the movement of the goal 50. The goal 50 is controlled to move according to the locus inputted by the player. This can be obtained through a conventional circuit design.

Further, a premium showcase 145 is arranged on the auxiliary body 2 in a rear position of the operation buttons 110 and has an upper surface made of a transparent acrylic plate allowing the player to see the premium therethrough.

The goal sensor(not shown) for detecting the goal through the basket is mounted to the goal 50. As described above, the first, the second and the third step motors 15, 25 and 35 are equipped with the left and right limit sensor, the front and rear limit sensor and the clockwise and counterclockwise rotation limit sensor, respectively, with the movements of the step motors being limited. Further, each of the step motors 15, 25 and 35 has an encoder electrically connected thereto for detecting a coordination value of X and Y in response to the movement of the goal 50 to control the position of the goal 50.

In addition, if the backboard 60 is made of a transparent acrylic and a hologram of, e.g., a logo of a manufacturer or a picture of basketball player is generated in a rear side of the backboard 60, a special visual effect may be provided.

Figure 6:
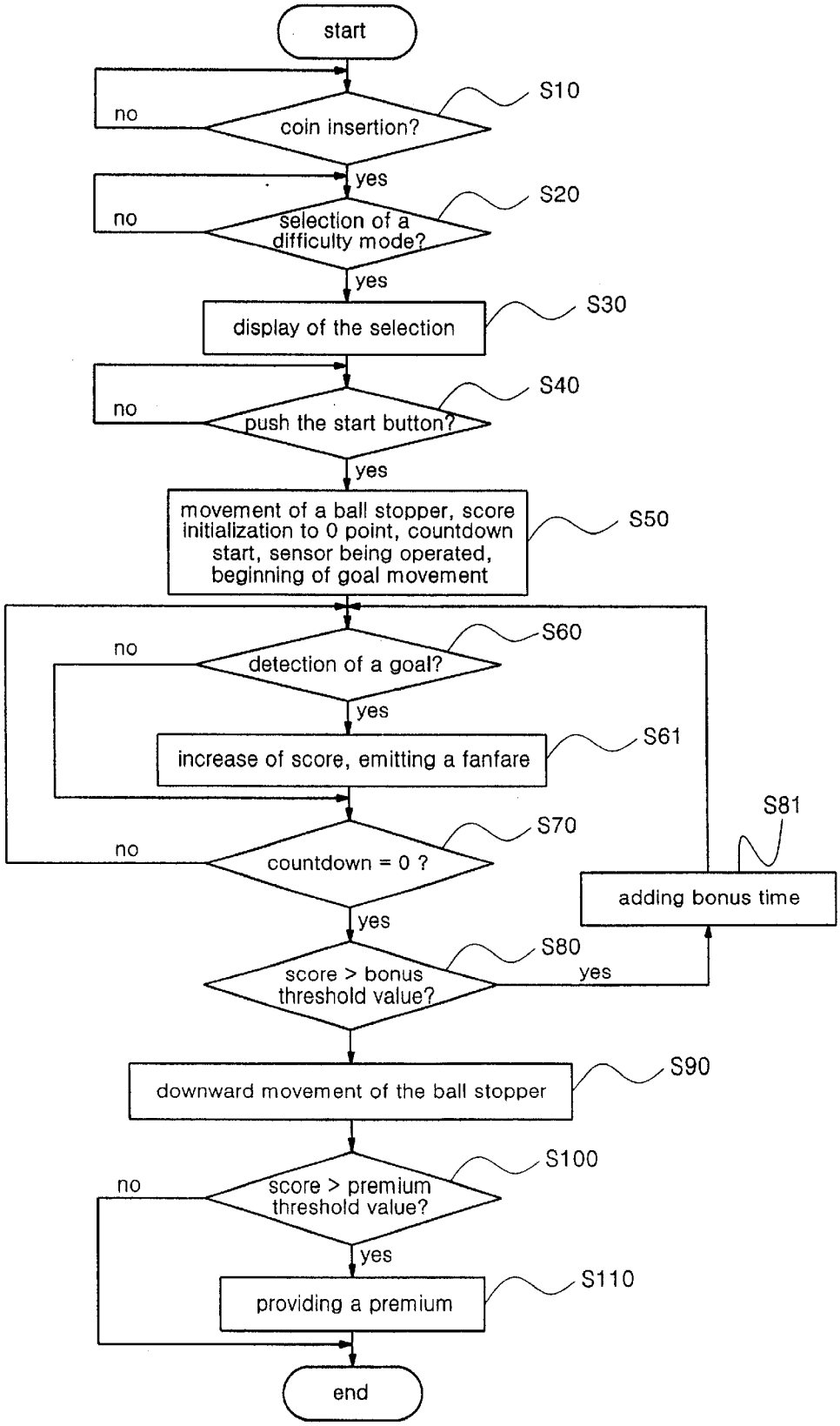
FIG. 6 discloses a flow chart in accordance with one embodiment of an intelligent basketball game assembly of the invention, in operation.

Processes of the basketball game using the inventive intelligent basketball game assembly will be described with reference to FIG. 6.

First, when the basketball game assembly is switched on, it enters a stand-by state. The player or user inserts coins into the coin insertion arranged on a front side of the basketball game assembly(S10). The control section 200 detects this through the coin detection and then indicates several grades of difficulty, e.g., easy mode, normal mode, or hard mode, etc. on the display panel. Then, the player selects one of the grades of difficulty(S20). The features according to the grades of difficulty is previously programmed in the control section. For example, in easy mode, the goal may be leftwardly or rightwardly moved, not rotating. In normal mode, the goal may be leftwardly, rightwardly, forwardly or rearwardly moved, not rotating. In hard mode, the goal may be leftwardly, rightwardly, forwardly or rearwardly moved, concurrently rotating within 90 degree clockwise or counterclockwise. For a high-skilled player, the goal may be moved according to the locus inputted by the player.

After the player selects the difficulty grade or the locus of the goal, the selection is displayed on the display panel(S30) and the game assembly enters a state of a stand by for start.

When the player ready for start pushes the start button (S40), a ball stopper is vertically moved to a predetermined height allowing the basketball to pass through by a driving motor for use with the ball stopper, with a score indicator is initialized to "0" point. At the same time, a lapsed play time is counted, and the left and right limit sensor, the front and rear limit sensor, the clockwise and counterclockwise rotation limit sensor are operated, with the goal beginning to move(S50). Next, the player starts to throw or shoot the basketball through the goal, with the control section detecting whether or not a goal has been made(S60).

If a goal is made, an increase of the score is indicated on the display panel, with a fanfare being emitted(S61). The control section checks if a current lapsed play time is equal to the termination time(S70). As a result, if the lapsed play time is past over the termination time, a next step is performed and, otherwise, the step S60 is performed again. If a goal is not made in the step S60, the step S70 is performed without the step S61.

Next, in the step S70, if the current lapsed play time is past over the termination time, the score which the player obtains is compared with a predetermined bonus threshold value (S80). As a result, if the score is equal to or higher than the threshold value, an additional time for play is given to the player as a bonus(S81). If the score is lower the threshold value, the ball stopper is moved down to come into a contact to the inclined surface of the ball returning member, preventing the basketball from rolling down toward the player (S90). Next, the final score is compared with a predetermined premium threshold value(S100).

If the final score is equal to or higher than the threshold value, the premium is offered to the player(S110) and, otherwise, the entire operation is terminated. Further, various kinds of the premiums may be arranged. In this case, different premium threshold values corresponding to the kinds of the premiums may be set and be compared with the score which the player obtains. As a result, the player receives an appropriate premium or gift depending upon his score.

As described above, an intelligent basketball game assembly of the invention has the goal movable along various locus by means of the leftward and rightward movement means and the forward and rearward movement means, rotatable by 90 degree clockwise and counterclockwise through the third step motor, thereby resulting that the player can enjoy the game at various angles without necessitating moving to the different places. The basketball game assembly may help a physical exercise as well as the basketball training.

Further, there exists an advantage in the basketball game assembly of the invention in that everyone may enjoy the game assembly, since it is designed to provide various grades of difficulties.

Moreover, the basketball game assembly of the invention has another advantage in that it may allow the player to repetitively practice the basketball in an optimized manner, since the player can freely input the movements which he wants using the touch pad.

Furthermore, the basketball game assembly of the invention has a function to provide the gifts or premiums according to the score which the player obtains, so that it may induce the participation of more many persons. It also has an advantage in that an impact of the game can be increased by providing a multimedia effect such as an audio and video effects.

Although the invention has been shown and described with respect to the preferred embodiments, it will be understood by those skilled in the art that various changes and modifications may be made without departing from the spirit and scope of the invention as defined in the following claims.

I claim:

1. An apparatus for playing a basket goal game, comprising:

a board having a surface;

a basket goal attached to the surface of the board and adapted to receive a tossed ball; and a mechanism coupled with the board and configured to linearly move the board in a first linear direction and a second linear direction perpendicular to the first direction, wherein the first and second directions are in a substantially horizontal plane.

2. The apparatus as defined in claim 1, wherein the mechanism is configured to move the board in the first and second directions either simultaneously or alternatingly.

3. The apparatus as defined in claim 1, wherein the mechanism is coupled to the board via a connection, and wherein the mechanism is configured to move the connection so as to move the board.

4. The apparatus as defined in claim 1, wherein the mechanism is further configured to turn the surface of the board.

5. The apparatus as defined in claim 4, wherein the mechanism is coupled to the board via a column having a central axis, and wherein the mechanism is configured to rotate the column about the central axis so as to turn the surface of the board.

6. The apparatus as defined in claim 5, wherein the basket goal circumferentially moves about the central axis of the column.

7. The apparatus as defined in claim 1, further comprising a controller configured to control operation of the mechanism so as to control the movement of the board.

8. The apparatus as defined in claim 7, wherein the controller is programmed with a plurality of modes of the operation of the mechanism.

9. An apparatus for playing a basket goal game, comprising:

a board having a surface;

a basket goal attached to the surface of the board and adapted to receive a tossed ball;

a mechanism coupled with the board and configured to move the board in a first direction and a second direction perpendicular to the first direction, wherein the first and second directions are in a substantially horizontal plane;

a controller configured to control operation of the mechanism so as to control the movement of the board; and an input device configured to receive an input of a path and to transmit a signal indicative of the inputted path to the controller, wherein the controller is further configured to control the operation of movement of the mechanism to effect the basket goal to move along a path substantially same as the inputted path.

10. The apparatus as defined in claim 9, wherein the input device comprises a touch pad having a surface, and wherein the touch pad is configured to recognize a path drawn on the surface.

11. The apparatus as defined in claim 8, further comprising at least one button for selecting a mode of the operation of the mechanism.

12. The apparatus as defined in claim 1, wherein the mechanism comprises a first direction movement device and a second direction movement device.

13. The apparatus as defined in claim 10, wherein the first direction movement device is coupled with the board so as to move the board in the first direction, and wherein the second direction movement device is coupled with the first direction movement device so as to move the first direction movement device in the second direction, thereby moving the board in the second direction.

14. The apparatus as defined in claim 1, further comprising a sensor configured to detect a ball passing through the basket goal.

15. The apparatus as defined in claim 1, further comprising a display to display the number of goals gained.

16. The apparatus as defined in claim 1, wherein the board is substantially vertically erected with reference to the earth.

17. The apparatus as defined in claim 1, wherein the basket goal comprises a hoop and an open-bottomed circular net.

18. A method of providing a basket goal game with the apparatus of claim 1, wherein a player throws a ball at the basket goal and gains a score when the ball enters the basket goal, the method comprising:

moving the basket goal attached to the board in the first linear direction;

moving the basket goal in the second linear direction perpendicular to the first direction;

monitoring balls entering the basket goal; and displaying a score gained based on the number of balls entering the basket goal.

19. The method as defined in claim 18, wherein the moving in the first direction and the moving in the second direction can be performed either simultaneously or alternatingly.

20. The method as defined in claim 18, further comprising:

receiving an input of a desired moving path of the basket goal; and controlling the first direction moving and the second direction moving so as to move the basket goal along a path substantially equal to the desired moving path.

21. The method as defined in claim 20, wherein the movement in the first direction comprises operating a first direction movement device coupled to the board, and wherein the movement in the second direction comprises operating a second direction movement device coupled to the first direction movement, whereby operation of the second direction movement device simultaneously moves the first direction movement device and the board in the second direction.

22. The method as defined in claim 18, wherein the board is coupled to the mechanism via a column, and wherein the moving in the first and second directions comprises operating the mechanism to move the column.

23. The method as defined in claim 18, further comprising circumferentially moving the basket goal about an axis.

24. The method as defined in claim 23, wherein the board is coupled to the mechanism via a column having a central axis, and wherein the circumferential movement comprises turning the column about the central axis in either of two opposed directions.

25. The method as defined in claim 18, wherein the movements of the basket goal in the first and second directions are controlled by a controller programmed with a plurality of operation modes.

26. The method as defined in claim 25, further comprising selecting a level of difficulty corresponding to one of the plurality of operation modes.

* * * * *